US005363781A

United States Patent [19]

Chang et al.

[11] Patent Number: 5,363,781

[45] Date of Patent: Nov. 15, 1994

[54] PLASMA TORCH-JET LIQUID WASTE TREATMENT DEVICE

[75] Inventors: Kuo-Ching Chang; Shih-Tsung Tseng; Jain-Sheng Huang, all of Hsingchu, Taiwan, Prov. of China

[73] Assignee: Industrial Technology Research Institute, Hsinchu, Taiwan, Prov. of China

[21] Appl. No.: 52,719

[22] Filed: Apr. 26, 1993

[51] Int. Cl.[5] ..... F23G 5/00

[52] U.S. Cl. ..... 110/250; 110/238; 110/346; 588/212

[58] Field of Search ..... 110/238, 250, 346; 588/212

[56] References Cited

U.S. PATENT DOCUMENTS

| | | | |
|---|---|---|---|
| 4,644,877 | 2/1987 | Barton et al. | 110/250 X |
| 4,909,164 | 3/1990 | Shohet et al. | 110/346 |
| 5,108,718 | 4/1992 | Dummersdorf et al. | 110/238 X |
| 5,206,879 | 4/1993 | Moody et al. | 110/250 X |

*Primary Examiner*—Edward G. Favors
*Attorney, Agent, or Firm*—Bo-In Lin

[57] ABSTRACT

The present invention comprises an apparatus for processing liquid or gas waste. The apparatus includes a high temperature plasma means for generating a high temperature in a plasma torch area. The apparatus further includes a jetting means for transporting and jetting the liquid or gas waste to the high temperature plasma torch area directly wherein a high temperature treatment of the waste is performed.

11 Claims, 3 Drawing Sheets

PLASMA TORCH-JET LIQUID WASTE TREATMENT DEVICE

BACKGROUND OF THE INVENTION

1. Field of the Invention

This invention relates generally to a waste treatment system and method. More particularly, this invention relates to a plasma torch-jet used for treatment of liquid and gas waste by the high temperature produced from the plasma torch-jet and and the breaking of chemical bonds through collisions of the electrons with the molecules thus decomposing the wastes into atoms or simple molecules.

2. Description of the Prior Art

The need for waste treatment in the hospitals, laboratories in a school or research institute, or the small factories are often small in scale and intermittent. When the liquid waste can not be properly treated by waste water treatment processes, it is usually stored over a prolong period of time until large quantity is accumulated for large scale treatment by a furnace or other appropriate processes. Such arrangement not only requires the use of more limited and often valuable space but also increases the difficulties and procedural complexity in liquid waste collection, storage, safety, transportation and often may impact the operation procedures of different instruments.

The application of the plasma technology to waste treatment, especially for high temperature processing of the toxic waste is well known. The theory and practice for generating plasma of high temperature over 10,000° C. by the use of electric arc over spaced electrodes have been disclosed in many previous U.S. Patents and need not be repeatedly described here in this application.

Chang et al. disclose in U.S. Pat. No. 4,886,001 entitled "Method and Apparatus for Plasma Pyrolysis of Liquid Waste" (issued on Dec. 12, 1989) a method and apparatus for pyrolytically decomposing waste material by injecting a mixture of waste and water or solvent into a plasma torch. The waste material is fed into the torch at an inlet together with a solvent which is fed via another inlet. The waste material mixed with the solvent is then processed in the plasma chamber near the plasma arc. A recombination chamber and scrubber are then used to further process the product gas and particulates generated by the high temperature plasma treatment.

Since Chang's method involves the mixing of the pre-processed waste material with the plasma process-gas, a pre-mixing with special solvent with certain ratios are required. Such process is more complex, requires special technical expertise and suitable only for larger scale operation. As pointed out by Chang et al., the advantage of the patented invention is to increase the feed throughput which are typically required for a central waste process station. Therefore, the invention of Chang et al. does not address the need and resolve the major design considerations of a small scale waste treatment system.

Kulkarni discloses in another U.S. Pat. No. 4,896,614 entitled "Method and Apparatus for Treatment of Hazardous Waste in Absence of Oxygen" a plasma waste treatment system wherein the hazardous waste is transported from a waste stockfeed to the plasma gun through a separate feed line. The plasma gun comprises an enclosed inner tube which is about seven to eight feet high wherein the high temperature plasma arc is generated. The waste material is fed into the inner tube for high temperature treatment. Kilkarni's apparatus is again designed for large scale operation. The system is maintained at high pressure and high temperature with complex piping system and control valves for treatment of large quantity of waste stock-piles.

Pineau et. al disclose in an U.S. Pat. No. 4,980,092 entitled 'Method for the Destruction of Chemically Stable Waste' a method for the destruction of chemically stable waste by pyrolysis utilizing at least one plasma torch. The waste generated inside a duct having an end orifice flows upward passing the orifice directing toward the nozzle of the plasma torch. The axis of the nozzle of the plasma torch and the axis of the orifice are substantially co-linear. The purpose is to precisely inject the gaseous or liquid waste to the high temperature zone of the plasma torch. However, for a small scale and non-continuous infrequent operation, the process to align the axis of the nozzle of the plasma torch to be co-linear with the axis of the orifice may be time consuming and requires special instruments. Additionally, unless the co-linear configuration can be securely maintained by other fixtures, the efficiency of the waste disposal may be greatly reduced if there is a displacement of orifice away from the nozzle of the plasma torch.

One major difficulty in applying the prior art technology to small scale liquid and waste treatment is that the waste material is introduced into the plasma torch area without precise control. When attempts are made to control, e.g., the invention as disclosed by Pineau et. al, the system may require additional operational processes by use of additional instruments which often render the system unsuitable for small scale operation.

Furthermore, the waste material in the larger waste treatment system is prevented from contacting the electrodes because of the larger size of the plasma torch. Also, the concern of maintaining and cleaning the electrodes is not a limitation in the prior applications because regular cleaning-up and maintenance of the electrodes by technical specialists are part of routine operational procedure for a central waste treatment station or larger plasma waste process reactors. This operation routine however may not be feasible for a low cost, small scale laboratory operation. There is still a need in the art of using the plasma torch for waste treatment to precisely control the injection of the waste to the plasma torch in order to overcome this limitation.

Therefore, for those skilled in the art, the need still exists for a waste treatment system which is small, easy to use, and can be operated near where small amount of liquid or gas waste is generated in an effective manner. Such system must also apply a technique capable of precisely controlling the injection of the waste to the plasma torch thus preventing direct contact of the waste material with the electrodes thereby the electrodes may be maintained clean continuously without requiring frequent service.

SUMMARY OF THE PRESENT INVENTION

It is therefore an object of the present invention to provide an apparatus and method for liquid and gas waste treatment which is suitable for processing small amount of waste.

Another object of the present invention is to provide an apparatus and method for precisely controlling the injection of the waste to the plasma torch thus preventing direct contact of the waste material with the electrodes thereby the electrodes may be maintained clean continuously without requiring frequent service.

Another object of the present invention is to provide an apparatus and method for liquid and gas waste treatment which is small and can be easily operated and controlled.

Another object of the present invention is to provide an apparatus and method for liquid and gas waste treatment by the use of high temperature generated by a plasma torch-jet and the breaking of chemical bonds through collisions of the electrons with the molecules wherein the waste treatment process is completed in short period of time without requiring large amount of air and producing only small amount of process waste.

Another object of the present invention is to provide an apparatus and method for direct liquid and gas waste treatment without requiring pre-mixing or pre-processing of the waste.

Briefly, in a preferred embodiment, the present invention comprises an apparatus for processing liquid or gas waste. The apparatus includes a high temperature plasma means for generating a high temperature in a plasma torch area. The apparatus further includes a jetting means for transporting and jetting the liquid or gas waste to the high temperature plasma torch area wherein a high temperature treatment of the waste is performed.

One advantage of the present invention is that it provides an apparatus and method for liquid and gas waste treatment which is suitable for processing small amount of waste.

Another advantage of the present invention is that it provides an apparatus and method for precisely controlling the injection of the waste to the plasma torch thus preventing direct contact of the waste material with the electrodes thereby the electrodes may be maintained clean continuously without requiring frequent service.

Another advantage of the present invention is that it provides an apparatus and method for liquid and gas waste treatment which is small and can be easily operated and controlled.

Another object of the present invention is to provide an apparatus and method for liquid and gas waste treatment by the use of high temperature generated by a plasma torch wherein the waste treatment process is completed in short period of time without requiring large amount of air and producing only small amount of process waste.

These and other objects and advantages of the present invention will no doubt become obvious to those of ordinary skill in the art after having read the following detailed description of the preferred embodiment which is illustrated in the various drawing figures.

DETAILED DESCRIPTION OF THE PREFERRED EMBODIMENT

Figure 1:
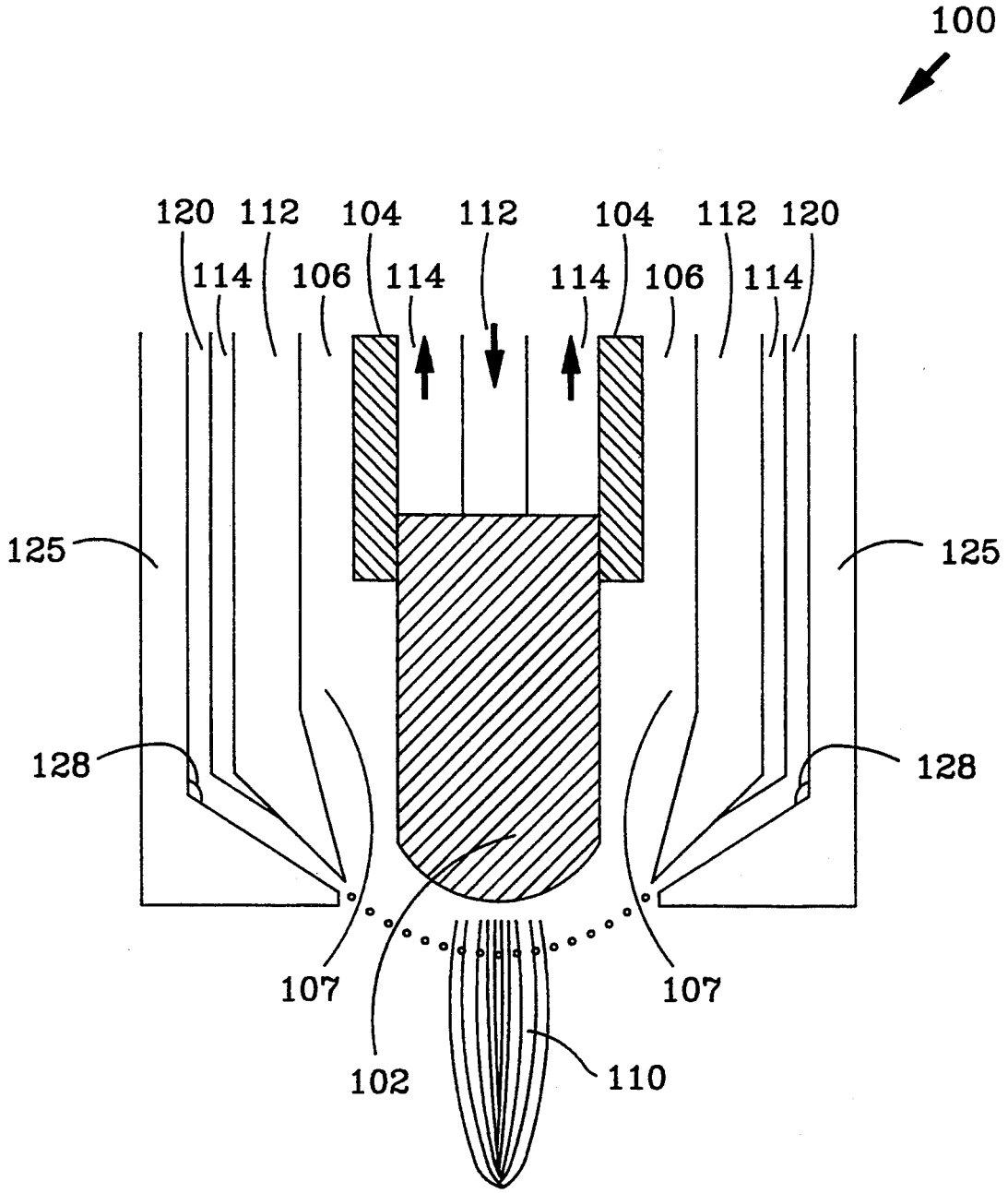
FIG. 1 is a front cross-sectional views of a liquid and gas plasma waste treatment apparatus of the present invention.

FIG. 1 shows a front cross-sectional view of a high temperature plasma torch-jet apparatus 100. The torch-jet apparatus can be structurally divided into many concentric annular zones wherein a negative electrode 102 is placed in the center-most zone surrounded by an insulating layer 104. The top portion of the electrode 102 is exposed such that the positively charged argon or nitrogen plasma gas injected from plasma tube 106. A high temperature torch 110 is generated through the plasma arc between the negative electrode 102 and the positive voltage 107 near the open end of the plasma tube 106. The electrode 102 is cooled by a plurality of water tubes 112 surrounding the electrodes 102. After cooling the electrode 102 each of the water tubes 112 has a returning tube 114 for returning the cooling water. Since the plasma near the torch 110 are operated at an extremely high temperature, the water tubes 112 are used to keep apparatus 100 below a limiting temperature. A cooler or heat exchanger (not shown) may be used to cool the water carried back by the returning water tubes 114.

The plasma torch apparatus 100 also includes a plurality of waste-material transporting tubes 120 for transporting the liquid and gas waste from a reservoir (not shown) to the tip portion of the plasma-jet near the plasma torch 110. The entire plasma torch-jet apparatus is then surrounded by a plurality of cooling water tube 125 at the outer peripheral to maintain the torch apparatus within an operation temperature range.

The number of the waste-material transporting tubes 120 and their diameters and lengths are designed to be most suitable for the waste-material to be transported and disposed. It also depends on the size and the temperature of the plasma torch 110. More transporting tubes 120 are used for a plasma torch-jet 100 for a torch 110 of larger size and higher temperature. In order to assure complete treatment of the waste material, it is generally desirable to transport the waste material by the use of many tubes 120 of small diameters. However, it would also increase the manufacturing cost of the plasma torch-jet apparatus 100. Meanwhile, the waste-treatment through-put may be adversely affected for some waste materials which are not easily transportable by the use of tubes 120 of small diameters.

The waste-material transporting tubes 120 are also formed to have a shape to have a small inward-bending angle $\theta$ (128) such that the liquid or gas wastes are injected right into the center of the torch 110 where it has the highest temperature. Because of the extreme high temperature, a complete decomposition of the hazardous waste can therefore take place within very short duration, e.g., in the order of micro-seconds.

The waste-material transporting tubes 120 can be manufactured as a replaceable modules. Each module may have different number of 30 transporting tubes 120, and the tubes 120 may have different diameters, lengths, and inward-bending angle $\theta$ (128) optimized according to the size and temperature of the plasma torch 110 and most suitable for the waste material to be disposed of. The replaceable transporting tube module can be easily removed for repair and maintenance thus the waste-treatment cost is reduced.

Figure 2:
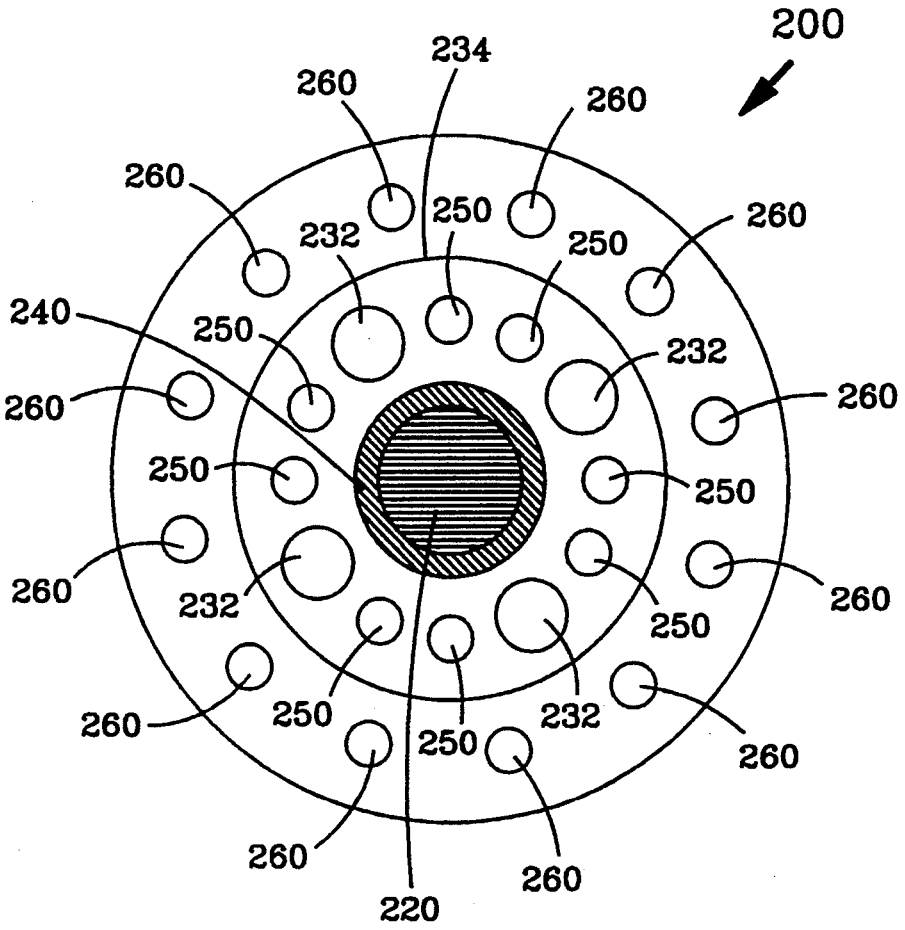
FIG. 2 is a top cross-sectional views of an alternate liquid and gas plasma waste treatment apparatus of the present invention.

FIG. 2 shows a top cross-sectional view of another high temperature plasma torch-jet apparatus 200. The torch-jet apparatus 200 is structurally divided into many concentric annular zones wherein a negative electrode 220 is placed in the center-most zone surrounded by an insulating layer 240. The insulating layer 240 is surrounded by a plasma tube wall 230 contains a plurality of plasma tubes 232 and water tubes 250 therein. The positively charged argon or nitrogen plasma gas is injected into the plasma tubes 232. Near the lower end of the opening of the plasma tube 232, a plasma arc is formed in a region between the plasma tube wall 230 with a positive voltage and the negative electrode 220. A high temperature torch is generated through the plasma arc between the negative electrode 220 and the positive voltage 230 near the open end of the plasma tube 230. The electrode 240 is cooled by a plurality of water tubes 250 surrounding the electrodes 240. After cooling the electrode 240 each of the water tubes 250 has a returning tube for returning the cooling water. Since the plasma near the torch is operated at an extremely high temperature, the water tubes 250 are used to keep apparatus 200 below a limiting temperature. A cooler or heat exchanger (not shown) may be used to cool the water carried back by the returning water tubes 250.

The plasma torch apparatus 200 also includes a plurality of waste-material jeting tubes 260 each of which has jet-opening for injecting the liquid and gas waste from a reservoir (not shown) to the tip portion of the plasma-jet near the plasma torch. The jet-openings are configured such that the waste materials transported from the jetting tubes 260 are injected directly into a high temperature zone of the plasma torch with precise control.

The number of the waste-material jetting tubes 260 and the jet openings and their diameters are designed to be most suitable for the waste-material to be transported and disposed. It also depends on the size and the temperature of the plasma torch. More transporting tubes 260 may be used for a plasma torch-jet 200 for a torch 234 of larger size and higher temperature. In order to assure complete treatment of the waste material, it is generally desirable to transport the waste material by the use of many tubes 260 of small diameters. However, it would also increase the manufacturing cost of the plasma torch-jet apparatus 260. Meanwhile, the waste-treatment through-put may be adversely affected for some waste materials which are not easily transportable by the use of tubes 260 of small diameters.

The waste-material transporting tubes 260 with their jet openings can also be manufactured as a replaceable modules. Each module may have different number of transporting tubes 260, and the tubes 260 may have different diameters, lengths, and opening diameters optimized according to the size and temperature of the plasma torch and most suitable for the waste material to be disposed of. The replaceable transporting tube module can be easily removed for repair and maintenance thus the waste-treatment cost is reduced.

Figure 3:
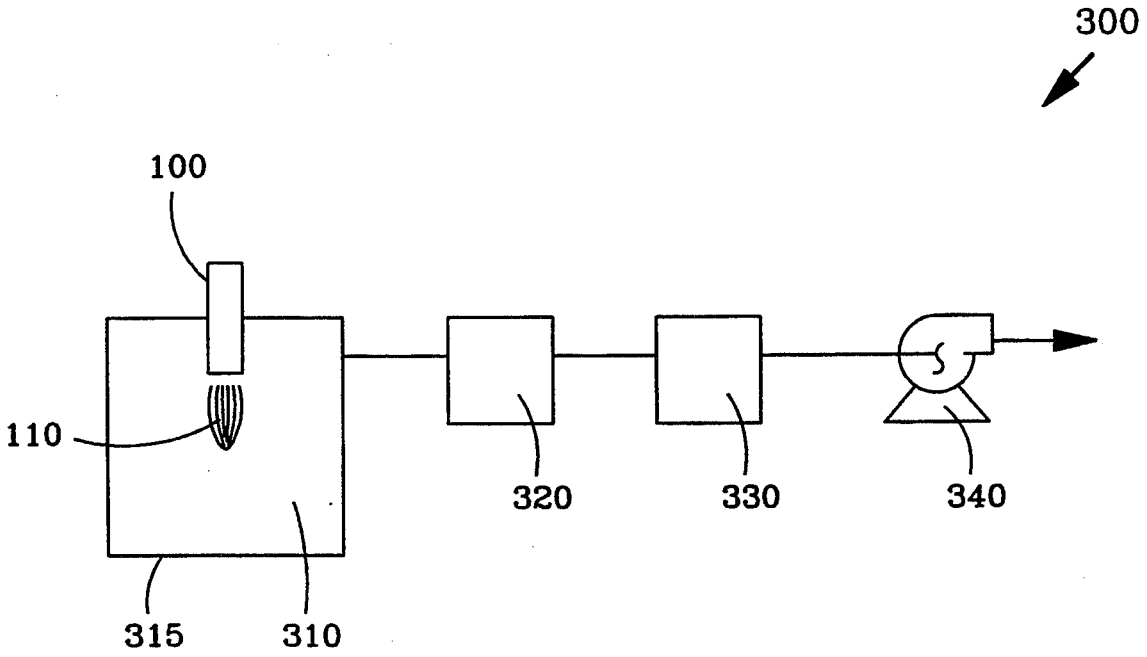
FIGS. 3 is a block diagram showing a waste treatment system utilizing the plasma heat treatment apparatus of FIG. 1 or FIG. 2.

FIG. 3 is a block diagram showing a waste treatment system 300 utilizing the plasma torch-jet 100 or 200. The waste treatment system 300 includes a plasma torch process chamber 310, a gas filtering chamber 320, an acid removing chamber 330 and a release stack 340. The plasma torch-jet apparatus 100 or 200 is placed in the plasma torch process chamber 310 contained in an enclosure means 315. The enclosure means 315 is a sealed enclosure for preventing waste gas and liquid from escape. The enclosure means also collects the gas and liquid products generated from the waste treatment process. The waste materials after being incinerated by the heat in the plasma torch-jet 100 and 200 are decomposed into atoms or simple molecules such as hydrogen ($H_2$), carbon monoxide (CO), carbon dioxide ($CO_2$), and hydrogen chloride (HCl). They are collected by the enclosure means 315 and pumped into a gas filtering chamber 320. The processed gaseous and liquid products after the filtering treatment are further processed by removing the acid in the acid-removing chamber 330 where the acids are neutralized by appropriate acid removing chemical agents. The products after these stages of processes are then released via the release stack 340 into the atmosphere.

Therefore, an apparatus and method for liquid and gas waste treatment suitable for processing small amount of waste is provided by the present invention. The waste treatment apparatus is small and can be easily operated and controlled near the locations where small amounts of liquid and gas wastes are generated. It provides a plurality of waste material transporting tubes for precisely controlling the injection of the waste to the plasma torch thus preventing direct contact of the waste material with the electrodes thereby the electrodes may be maintained clean continuously without requiring frequent service Because the use of high temperature generated by a plasma torch, the waste treatment process is completed in short period of time without requiring large amount of air, only small amount of process waste is produced which can be easily filtered and re-processed for safe release to the environment.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. An apparatus for processing liquid or gas waste comprising:

a high temperature plasma means for generating a high temperature plasma torch;

a jetting means including a plurality of transporting tubes for directly transporting and jetting said liquid or gas waste to said high temperature plasma torch wherein a high temperature treatment of said waste is performed; and said jetting means including said plurality of transporting tubes is integrated with said high temperature plasma means to form an independently transportable assembly.

2. An apparatus for processing liquid or gas waste comprising:

a high temperature plasma means for generating a high temperature plasma torch wherein said high temperature plasma means is an elongated tubular plasma means including electrodes for generating said high temperature plasma torch; and a jetting means including transporting tubes along said elongated tubular plasma means, each of said transporting tubes has an jet-opening near said plasma torch for jetting said liquid or gas wastes into said high temperature plasma torch.

3. The waste disposal apparatus of claim 2 further comprises:

a plurality of cooling means including a plurality of water tubes disposed near said elongated tubular plasma means for cooling said tubular plasma means.

4. The waste disposal apparatus of claim 2 wherein:

said transporting tubes bend toward said plasma torch near said jet-opening for precisely jetting said liquid or gas wastes into said high temperature plasma torch.

5. The waste disposal apparatus of claim 1 wherein:

said high temperature plasma means is an elongated tubular plasma means including electrodes for generating said high temperature plasma torch; and said jetting means including said transporting tubes wherein each of said transporting tubes has an jet-opening near said plasma torch for jetting said liquid or gas wastes into said high temperature plasma torch.

6. A liquid and gas waste treatment system comprising:

a plasma apparatus including a high temperature plasma means for generating a high temperature plasma torch;

said plasma apparatus further including a jetting means which includes a plurality of transporting tubes for directly transporting and jetting said liquid or gas waste to said high temperature plasma torch wherein a high temperature treatment of said waste is performed;

said jetting means including said plurality of transporting means is integrated with said high temperature plasma means to form an independently transportable assembly; and an enclosure means for containing said plasma apparatus for preventing liquid and gas leakage from said enclosure means.

7. A liquid and gas waste treatment system comprising:

a high temperature plasma means for generating a high temperature plasma torch wherein said high temperature plasma means is an elongated tubular plasma means including electrodes for generating said high temperature plasma torch;

said plasma means further including a jetting means which including transporting tubes each has a jet-opening near said plasma torch for jetting said liquid or gas wastes into said high temperature plasma torch;

a plurality of cooling means including a plurality of water tubes disposed near said elongated tubular plasma means for cooling said tubular plasma means; and an enclosure means for containing said plasma apparatus for preventing liquid and gas leakage from said enclosure means.

8. The liquid and gas waste treatment system of claim 7 further comprises:

a second stage gas treatment means including a filtering means and an acid removing means for receiving from said enclosure means a decomposed waste gas generated by the high temperature treatment and for filtering and removing acids from said decomposed waste gas.

9. The liquid and gas waste treatment system of claim 8 further comprises:

a final release means for releasing the further processed waste gas from said second stage treatment means.

10. An apparatus for processing liquid or gas waste comprising:

a high temperature plasma means for generating a high temperature plasma torch;

a jetting means including a plurality of transporting tubes for directly transporting and jetting said liquid or gas waste to said high temperature plasma torch wherein a high temperature treatment of said waste is performed;

said jetting means including said plurality of transporting tubes is integrated with said high temperature plasma means to form an independently transportable assembly; and said jetting means including said plurality of transporting tubes further forming a replaceable module.

11. The apparatus for processing said liquid and gas waste of claim 10 wherein:

said jetting means including said plurality of transporting tubes wherein said transporting tubes have different sizes for transporting said liquid and gas waste therein.

* * * * *